US006655559B2

(12) United States Patent
Lopata et al.

(10) Patent No.: US 6,655,559 B2
(45) Date of Patent: Dec. 2, 2003

(54) CURLY RIBBON PRODUCT MAKING MACHINE

(76) Inventors: Ira L. Lopata, 1076 N. Ocean Blvd., Palm Beach, FL (US) 33480; Robert M. Barto, Jr., 130 Coral Cay Dr., Palm Beach Gardens, FL (US) 33418; Fredric Goldstein, Varmdovagen 207, 13141 Nacka (SE)

( * ) Notice: Subject to any disclaimer, the term of this patent is extended or adjusted under 35 U.S.C. 154(b) by 0 days.

(21) Appl. No.: 10/103,431

(22) Filed: Mar. 21, 2002

(65) Prior Publication Data

US 2002/0148086 A1 Oct. 17, 2002

Related U.S. Application Data

(62) Division of application No. 09/583,376, filed on May 30, 2000, now Pat. No. 6,360,413.

(51) Int. Cl.[7] ..... D04D 7/06
(52) U.S. Cl. ..... 223/46; 28/147
(58) Field of Search ..... 28/147, 149, 150, 28/143, 247, 260; 223/44, 46; 428/4, 5; 493/955, 459, 460; 7/158; 242/522, 523, 524.1, 526, 527, 527.5, 530, 530.2, 538, 419.4, 532.5

(56) References Cited

U.S. PATENT DOCUMENTS 1,063,288 A * 6/1913 Rosenberg ..... 28/147
3,000,074 A * 9/1961 Butkiewicz ..... 28/147
3,097,771 A * 7/1963 Kerrigan et al. ..... 223/46
3,291,352 A * 12/1966 Grikis ..... 223/46
3,300,107 A * 1/1967 Koch ..... 223/46
3,790,041 A * 2/1974 Pearson et al ..... 223/46
4,201,352 A * 5/1980 Madachy ..... 242/419.4
4,896,802 A * 1/1990 Nanami ..... 223/46
5,072,865 A * 12/1991 Lyons ..... 223/46
5,232,132 A * 8/1993 Broussard et al. ..... 223/44
5,916,081 A * 6/1999 Goldstein ..... 493/459

* cited by examiner

*Primary Examiner*—Amy B. Vanatta
(74) *Attorney, Agent, or Firm*—Norman Friedland

(57) ABSTRACT

In one embodiment a hand operated machine for making curly ribbon products comprises a rotary drum that includes a station to attach the uncurled ribbons (more than one), a cutting station to cut the curled ribbons, and a stapling station to staple the ribbons together or to a card, ribbon, or the like. A handle is provided to rotate the drum and a fixed curling mechanism mounted downstream of the drum serves to curl the ribbon as the drum rotates to place the ribbon in contact with the curling mechanism. In another embodiment the machine is automated and includes a drum that has the same stations. The attaching station includes a pair of jaws that are sequentially movable one relative to the other and together to attain attaching the ribbons to the drum for the first cycle, detaching the ribbon during the first cycle and attaching the succeeding ribbon used in the next cycle for mass producing the curly ribbon product. The stapling and cutting are automatic and the card feeding machine is movable relative to the drum to avoid snarling the ribbon when released. The curling mechanism is adjustable to change the exit angle to select the desired curl characteristics of the curled ribbon.

25 Claims, 14 Drawing Sheets

CURLY RIBBON PRODUCT MAKING MACHINE

This is a divisional of application Ser. No. 09/583,376, filed May 30, 2000, now U.S. Pat. No. 6,360,413.

TECHNICAL FIELD

This invention relates to a ribbon curling machine and more particularly to both a hand operated ribbon curling machine and an automatic ribbon curling machine for producing a multiple curled ribbon decorative product where the ribbons overlie each other and are attached together. In some embodiments the curled ribbons are attached to a self sticking backing card or a bow or a display holding card or the like.

BACKGROUND OF THE INVENTION

As is known to those skilled in this technology, there are sundry ways in which to curl ribbon of the type that are typically used to decorate packages, flowers/cookie baskets and the like. One of the more arcane methods of curling is by sliding the ribbon over a knife-edge or any other object where the ribbon slides over a friction surface. For example the simple operation of sliding the ribbon over the edge of ordinary pair of scissors causes the ribbon, be it paper or plastic, to curl. This obviously has limitations, such as being slow, typically done for a single ribbon, and in the more common usage the practice was to curl the end portions of a typical decorative bow. Other types of curling has been done by hand-held curling tools as those described In U.S. Pat. Nos. 5,400,452 granted on Mar. 28, 1995; 5,564,145 granted on Oct. 25, 1996; 5,407,417 granted on Apr. 18, 1995 to Fredric Goldstein, one of the joint inventors of this patent application. Obviously, like the scissors described above, the curling tools disclosed in the immediately aforementioned patents all would require tedious curling and assembly of the curled ribbon strands.

In more recent years, the curling of the ribbon has become automated where a drawing apparatus draws the ribbon to be in frictional engagement with an edge to impart a curl to the ribbon and stripping mechanism that permits the mass production of the curled ribbon which can then be utilized for different types of applications. Examples of this type of mass produced curled ribbon is disclosed in U.S. Pat. Nos. 5,518,492 granted on May 21, 1996, 5,711,752 granted on Jan. 27, 1998 and 5,916,081 granted on Jun. 29, 1999 to Fredric Goldstein, a co-inventor of this patent application.

Also, we are aware of other machines that has the ability of making a curled product that has certain similarities to the end product of this invention and is made by an entirely different method. In one instance, a reciprocal sliding mechanism includes a clamp that holds a ribbon while it is drawn over a stapling device. The ribbon is laid over itself to form a stack of curled ribbons and a stapling device staples the ribbon to a backing card and the cycle is repeated.

This invention is primarily concerned with the curled ribbon that is packaged in one or a number of configurations including the configuration as shown in FIG. 1 of this patent application (curly ribbon). As noted therein, this curled ribbon ribbon product has four (4) curled ribbons 2 each of which are stapled in the center via staple 4. This makes eight (8) strands of curled ribbons 3 emanating from staple 4. Obviously, when a given length of ribbon is attached intermediate the ends of the ribbon by a staple, the portions of the ribbon emanating from the staple forms two (2) strands. In this end curly ribbon product card 5 and ribbons 2 are stapled together. The card which is designed to hang in a display rack may include one surface (not shown) coated with a glue and a paper cover that is removable to uncover the glued surface for sticking to a package and the front surface may include indicia, such as a logo, price, etc. Obviously, in other embodiments the card may be replaced by or made complementary to other devices or objects such as a bow, ribbon, string etc. It obviously should be understood that the FIG. 1 end product is simply one example of an end product of a curly ribbon product. The end product could include as many strands as desired, and it is typical that more than eight (8) strands are formed to make-up the end product.

In one embodiment of this invention, the apparatus for making this product is portable and hand-operated and in an other embodiment of this invention, the product is automatically produced. It will be appreciated that in both embodiments, the ribbon is wrapped around a drum or rotor as it is rotated about an axis either by hand or a motor and that at discreet locations on the drum are provided mechanism for clamping the ribbons onto the drum, stapling the ribbons and card together and cutting the ribbons in another appropriate location. Obviously, the curled ribbon for some decorative purposes are affixed at an intermediate portion and for others they are affixed at the end.

In one preferred embodiment of this invention, a hand operated drum, reel or disk (hereinafter referred to as a drum) mounted for rotation and includes a handle attached to the drum for causing the rotation. This embodiment also includes a number of posts for holding a number of spools of ribbon, an equal number of guide posts for each of the spools, an equal number of curling heads where the ribbon is placed in frictional engagement or contact to impart the curl thereto and a single guide post where all the ribbons are accumulated in such a manner that a portion of the ribbon is laid over other portions to form a stack to allow clamping with a single clamp. The drum includes stations to hold the combined ribbons with the use of an alligator clamp, and predetermined stations, one to staple the ribbons together and another to cut the ribbons. A card holder mechanism may be employed at the stapling station where the ribbons and card are simultaneously stapled together.

In another embodiment of this invention, an automated machine mass produces the entire package automatically once the machine is initially threaded. In this embodiment and according to this invention, a clamping mechanism including a pair of jaws judiciously clamps the then curled ribbon to the drum after being curled, the clamp releases the processed ribbon once the drum grasps the ribbons and sequentially re-clamps the next to be processed ribbons to continuously and cyclically produce an entire finished product. Also in accordance with this invention, this automated machine judiciously staples and judiciously cuts the curled ribbons in the proper sequence to produce the end product.

The advantages of utilizing a drum as taught by this invention and without limitation are as follows:

1) the drum provides a compact drive system, more compact than heretofore known systems, making it possible to have a machine which requires minimal space, and in the portable unit, it can fit on an ordinary kitchen table or the like;
2) the strands are inherently stacked together in the process of being pulled, unlike sets of wheels which would have to guide the 12 strands, for example, upon each other, which is critical when stapling or attaching the ribbon strands to a card;

3) the drum obviates the need of sets of wheel or roller drive systems and the necessity of synchronizing the wheels and rollers in these types of systems and avoids the potential of "looping";
4) the drum, obviously, can increase the number of strands simply by increasing the number of revolutions in a cycle;
5) because the ribbon wraps around itself on the drum the ribbon eventually secures itself to the drum and the clamp for originally clamping ribbon to the drum is released. Thus the drag on the drum is reduced as the rotation continues. This obviates the problems of adverse release and tearing of the ribbon in heretofore known systems. and
6. the system using the drum always ends in the starting position for the next set of strands avoiding the necessity of repositioning the mechanism to begin the process.

In another aspect of this invention, the amount of curl can be controlled by selecting the proper discharge angle that the ribbon makes relative to the surface where the curl is imparted. Typically, the more acute the angle and hence the amount of drag or friction imparted to the ribbon as it is makes contact with the member imparting the drag or friction, the greater the degree of curl in the ribbon. This is the case no matter what the material the ribbon takes. This feature significantly allows the user to decide the overall size and shape of the curled ribbon product, whereby acute angles provides a more compact curled bow while lesser acute angles provides larger more flowing curls. When producing the curled ribbon product by an automated machine the curling device of this invention allows for consistency and flexibility in production.

SUMMARY OF THE INVENTION

An object of this invention is to fabricate a curled ribbon end product either manually or automatically by winding a plurality of ribbons around a rotating body and simultaneously imparting a curl thereto and then affixing the ribbons to another member and cutting the ribbon at different locations on the rotating body.

A feature of this invention is to provide a hand operated machine for making curled ribbons and attaching a plurality of ribbons taken from spools of ribbons to a clip or bobbin that is inserted into a rotatable drum that is rotated about an axis as by a handle mounted on the drum to draw the ribbons over a curling mechanism and which drum includes different stations for stapling the ribbons to each other and/or a card and for cutting the curled stapled ribbons.

Another feature of this invention is to provide a machine for automatically curling ribbons, attaching the curled ribbons to the drum of the machine, stapling the curled ribbons together at one station of the drum and cutting the ribbons at another station of the drum for producing a decorative piece. It will be appreciated that unless the ribbon upstream of the cutting or severing device is clamped prior to cutting, the ribbon will become disengaged from the drum and disrupt the cycle.

Another feature of this invention is to provide a curling device for imparting a curl to the ribbon that includes mechanism for changing the exit angle that the ribbon makes with the curling mechanism to control the curl characteristics of the ribbon.

Another feature of this invention is to provide a clamp that comprises automated fingers or jaws that are Controllable to temporally clamp, release and re-clamp a plurality of ribbons wound around a rotating drum.

Another feature of this invention is to provide an automatic machine for mass producing decorative curled ribbons by curling each of a number of ribbons and then combining and processing the combined ribbons through a number of sequential operations including the steps of winding the plurality of ribbons around a drum after being curled, affixing the curled ribbons to a card having a glued backing with the use of an automatic card feeding and stapling mechanism, an anvil, separately cutting the assembled card and curled ribbons that are attached to the card and releasing the assembled unit from the machine.

Another object of this invention is the method for producing a decorative multi-colored curled ribbon end product from a continuous supply of different colored uncurled ribbons including the steps of combining the different colored ribbons, stapling and cutting thereof.

Another feature of this invention is to provide a method that cyclically produces a curled ribbon product by the steps of providing a rotating drum, a clamp for clamping a plurality of ribbons which may be of different colors to a the drum until the ribbons are self-supported to the drum and then releasing the clamp from the ribbons, re-clamping the plurality of ribbons, affixing the ribbons together and then cutting the affixed ribbons in one cycle so as to provide a continuous process for mass producing the end product without the necessity of manually feeding the machine after the initial feed.

A still further object of this invention is to teach a system for making curled ribbon product that is characterized as being simple and inexpensive to use and manufacture as well as affording the following advantages:

1) a compact drive system, more compact than heretofore known systems is attained, making it possible to have a machine which requires minimal space, and in the portable unit, it can fit on an ordinary kitchen table or the like;
2) the strands are inherently stacked together in the process of being pulled, unlike sets of wheels which would have to guide the 12 strands, for example, upon each other, which is critical when stapling or attaching the ribbon strands to a card;
3) it obviates the need of sets of wheel or roller drive systems and the necessity of synchronizing the wheels and rollers in these types of systems and avoids the potential of "looping";
4) it increases the number of strands simply by increasing the number of revolutions in a cycle;
5) because the ribbon wraps around itself on the drum the ribbon eventually secures itself to the drum and the clamp for originally clamping ribbon to the drum is released. This obviates the problems of adverse release and tearing of the ribbon in heretofore know systems; and
6. the system always ends in the starting position for the next set of strands avoiding the necessity of repositioning the mechanism to begin the process.

The foregoing and other features of the present invention will become more apparent from the following description and accompanying drawings.

These figures merely serve to further clarify and illustrate the present invention and are not intended to limit the scope thereof

DETAILED DESCRIPTION OF THE INVENTION

While the invention in its preferred embodiment utilizes a particularized curling mechanism and stapling card it is be understood as one skilled in this art will recognize that this invention contemplates utilizing any type of curling mechanism and the stapling can be to any object such as a bow and the stapling can include other means of attaching the ribbons together and/or attaching objects thereto such as by fusion or adhesives or pinning or card locking or the like. It is also to be understood that the shape and/or configuration of the drum can take any form so long as it rotates about an axis and is capable of supporting the ribbons around the periphery thereof. As one skilled in this art will appreciate, the length of the strands are determined by the circumference of the drum and obviously, the length of each strand will be predicated on the circumference selected for the drum. For example a drum whose circumference is 38 inches (approximately 12 inches in diameter) will produce a curled ribbon that is 38 inches long and hence each strand will be 19 inches long.

Figure 2:
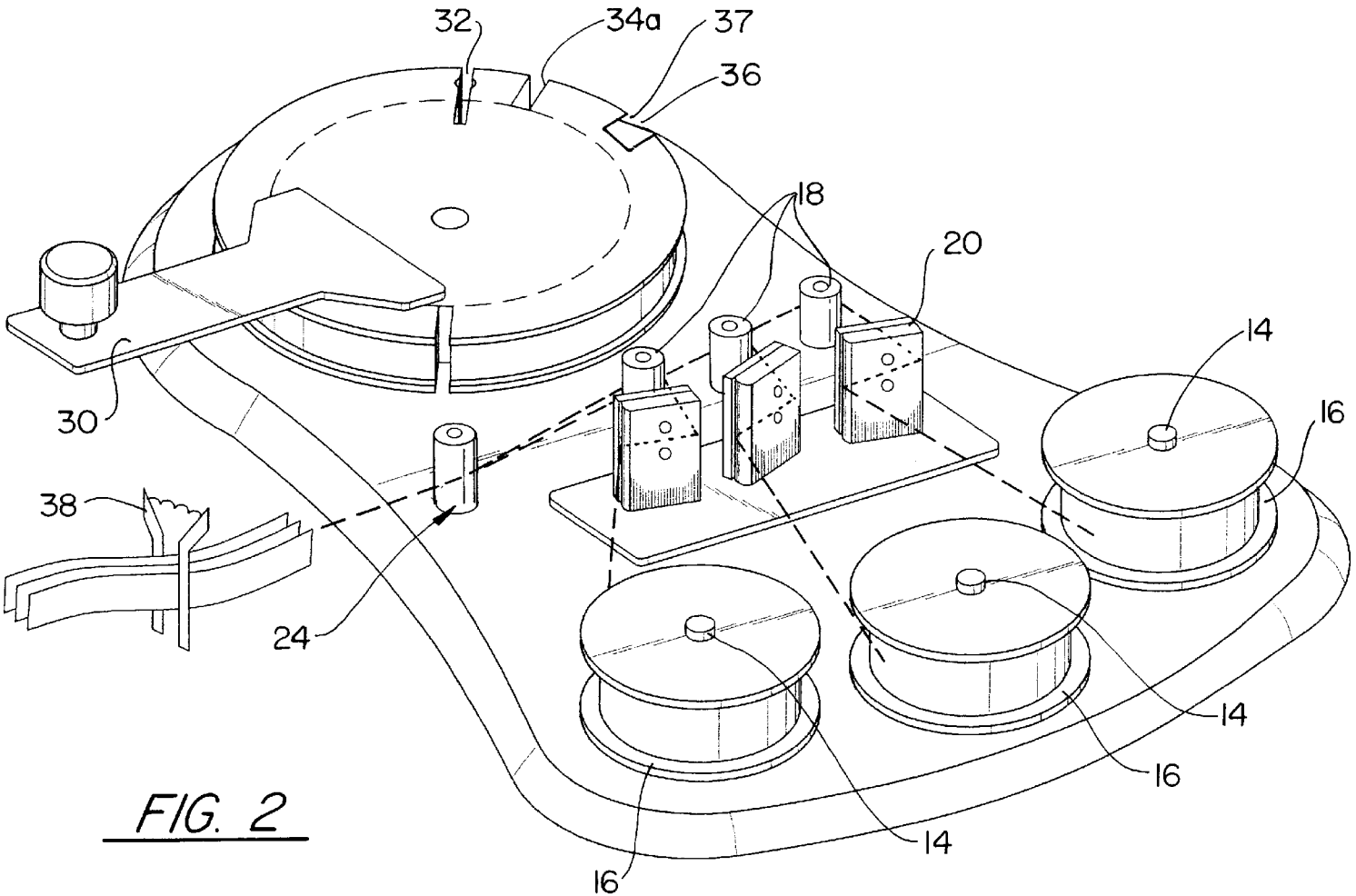
FIG. 2 is a perspective view of the hand operated curl making machine of this invention.
Figure 2A:
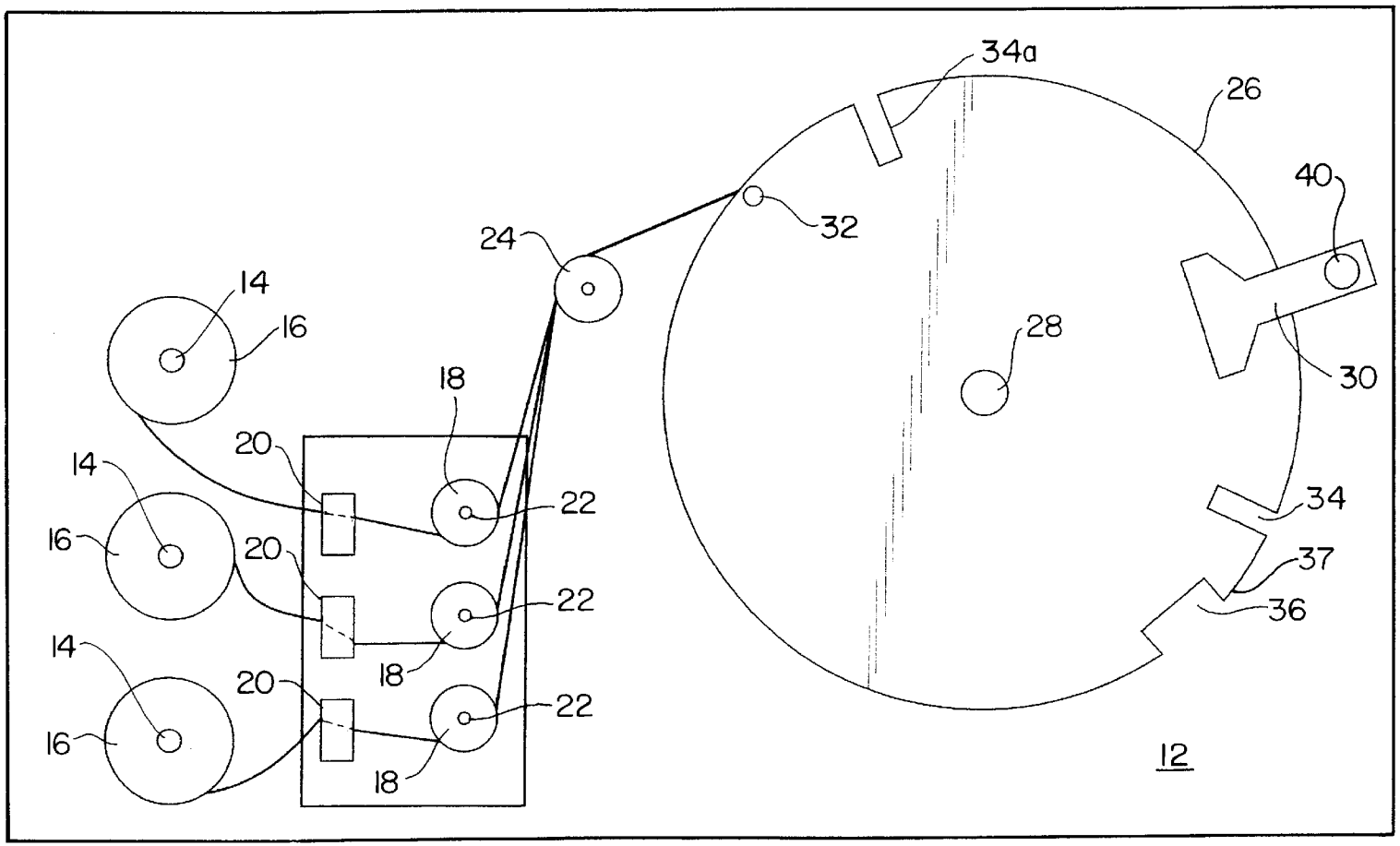
FIG. 2A is a schematic view of the embodiment depicted in FIG. 2.
Figure 3:
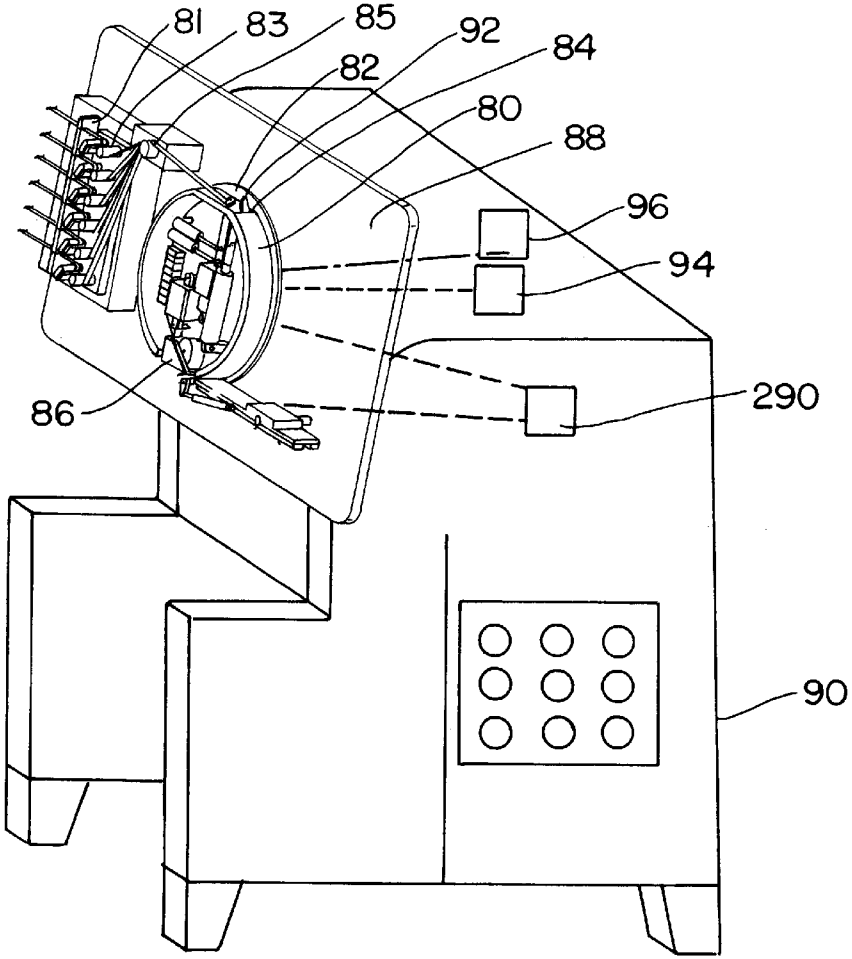
FIG. 3 is a view in perspective and schematic illustrating a portion of the automated machine of this invention.
Figure 4:
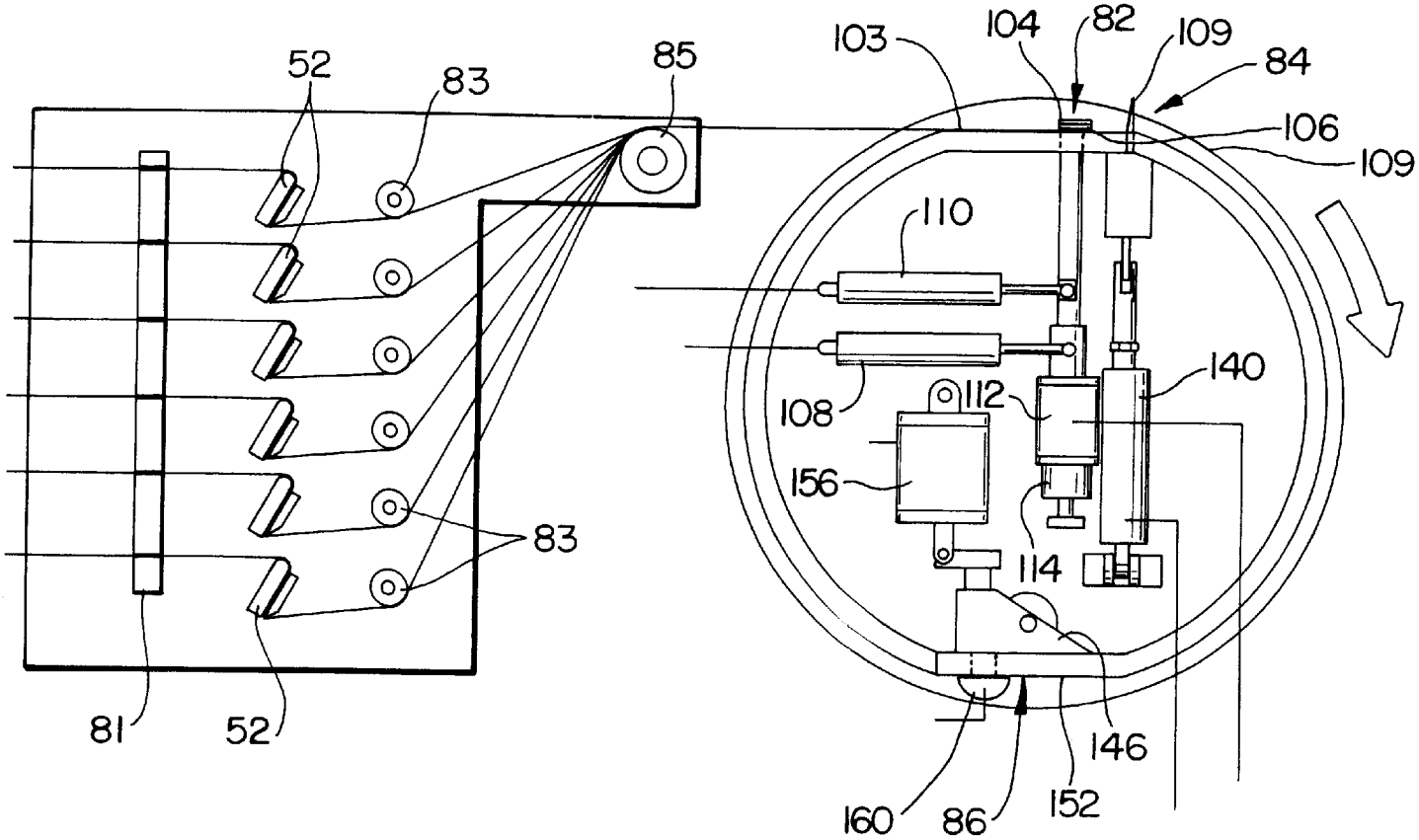
FIG. 4 is a schematic illustration of the various stations on the drum and the actuation mechanisms associated with each of the stations for the automated machine of this invention.

The invention with respect to the hand operated embodiment can best be understood by referring to FIGS. 2 and 3. The portable hand operated curling machine generally illustrated by reference numeral 10 comprises the generally flat base 12 supporting a plurality of upstanding stub shafts or spindles 14 for supporting spools of ribbons 16. In this instance, three spools of uncurled ribbons are shown, but it is to be understood that any number of spools can be utilized and the number of ribbons selected to form the curled ribbon end product is a matter of choice of the user. A complementary guide spool 18 for each of the spindles 14 are disposed between the curling mechanism 20 that is affixed to the base and the curling drum 26 for guiding the ribbon through the respective curling mechanism 20. The curling mechanism will be described in detail hereinbelow. Each of the guide spools 18 are loosely fitted on a support spindle 22 affixed to base 12. These guide spools 18 are free to rotate and afford substantially little if any resistance to the ribbon as is travels through the machine 10. Another single guide spool 24 similarly attached to a support spindle affixed to base 12 and also loosely fitted to freely rotate is mounted between the curling mechanism 20 and the curling drum 26 and guides the three (3) ribbons in an overlapping configuration.

Figure 1:
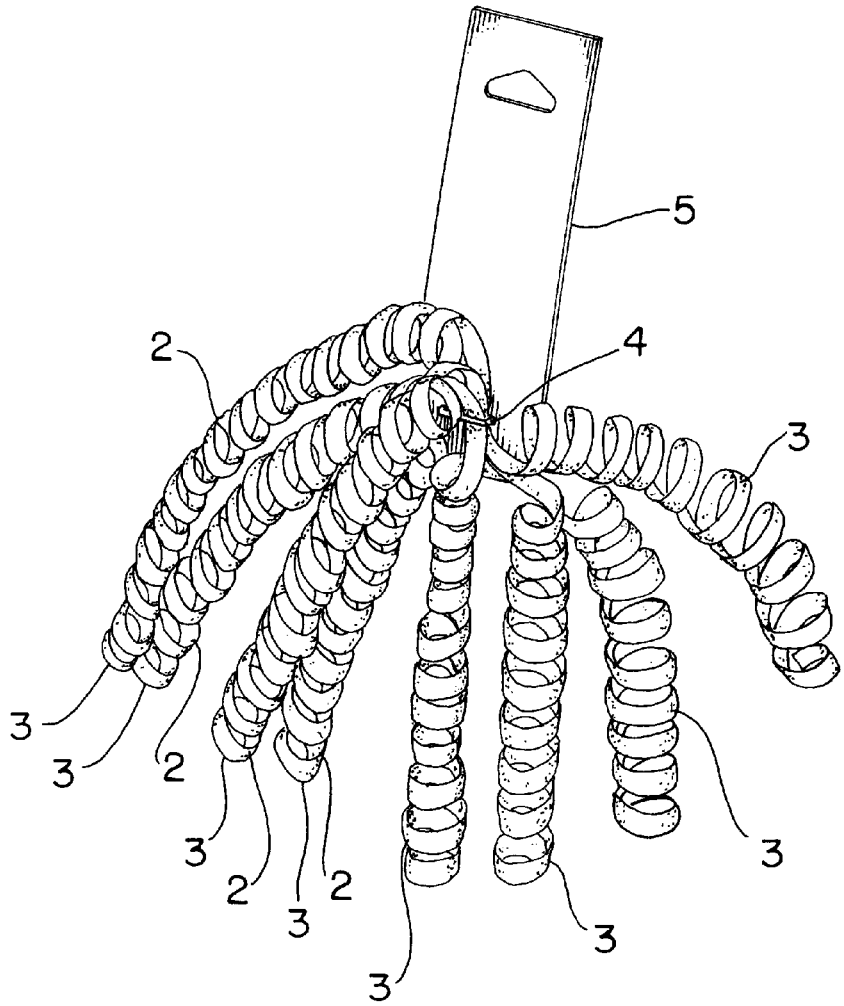
FIG. 1 is a perspective view showing one version of the decorative curled ribbon after being processed.

The curling drum 26 is rotatably supported to a stub shaft 28 affixed to base 12 and rotates thereabout by virtue of the movement of the handle 30. Essentially the curling drum 26 consists of at least three stations, namely, the attachment or clamping station 32, the cutting station 34, and the stapling station 36. The attachment station 32, the cutting station 34 and the stapling station 36 are slots or holes and slots that extend through the width of the drum 26 or at least a sufficient distance to perform the functions as will be described immediately below and are formed adjacent the periphery of the drum 26. The distance between the cutting station 34 and the stapling station 36 determines at which point the ribbons will be attached to each other. As shown in this embodiment the curled ribbons are being attached at their respective ends. To attach the ribbons at another point, for example, the cutting slot 34*a* is formed at cutting station 34*a*. At this station the ribbon will be attached intermediate the ends and will form a decorative curled ribbon as shown in FIG. 1.

In operation, each of the uncurled ribbons 16 are threaded and clamped through the respective curling mechanism, then laid adjacent to the respective guide spools 18 and then laid adjacent to the single guide spool 24 and the ends of the ribbons are held together in the overlapping position by the commercially available alligator clamp 38 which, in turn, is inserted by the operator into the aperture formed in the drum at the attachment station 32. This secures the ribbons to the drum 26. The operator with the use of the knob 40 affixed to handle 30, rotates the drum 26 a number of revolutions until the desired end product is achieved, i.e. the number of curled ribbons constituting the end product is obtained. For example, if two (2) revolutions of the drum are made with three uncurled ribbons and the cut is 180° away from the staple station, the end product will include twelve (12) strands of curled ribbon emanating from the staple. On the other hand, if the cut is adjacent to the staple station, the number of strands of curled ribbons will be six (6), albeit twice as long. With an ordinary, commercially available stapler (not shown) with the base fitted into the slot 34*a* and the hammer head of the stapler straddling the ribbon, the staple is inserted into the ribbons. The stapling station 36 may include a wedged shaped portion 37 on either side of the slot which is designed to hold a card adjacent to the curled ribbons and in this instance the card is concomitantly stapled to the ribbons as shown in FIG. 1. The operator next, with the use of commercially available scissors (not shown) inserts the blades of the scissors to straddle the ribbons and snips the ribbons to produce the end item. Obviously, the ribbons can be cut with any other well known device, such as a knife or razor. The curled ribbons as processed by this portable curling machine produces the decorative piece as the end item which is ready for use to decorate a package, basket and the like. Obviously, from the foregoing it is easy to understand that the machine is so simple to operate that it is usable by practically all persons, is portable and sufficiently small and light weight to be easily stored.

Figure 5:
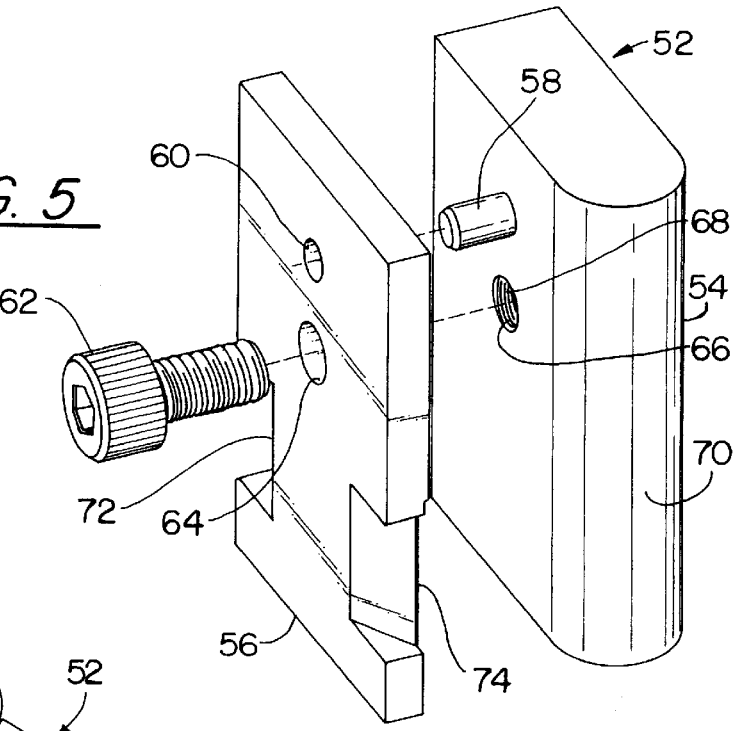
FIG. 5 is an isometric exploded view illustrating the details of the curling mechanism of this invention.

The next portion of this application will describe the automated curling machine generally indicated by reference numeral 50. Like the drum described in connection with the hand operated curling machine depicted in FIG. 2, this automated machine 50 also includes a drum that wraps the ribbon around the periphery thereof and the drum includes stations for clamping the ribbon, stapling and cutting the ribbons as will be described hereinbelow. Before describing the entire machine, it is noted that the curling mechanism shown in FIGS. 5 and 6 is substantially the same as the curling mechanism utilized in connection with the machine depicted in FIG. 2 and for the sake of convenience and simplicity this curling mechanism is being described at this point in the disclosure.

In its preferred embodiment the curling mechanism generally indicated by reference numeral 52 generally consists of two (2) generally cooperative flat plate elements 54 and 56. Obviously, any type of mechanism that imparts a frictional force when the ribbon is moved in contact therewith that produces a curl can be employed. This particular mechanism has been selected because the exit angle can be changed so as to control the degree of curl in the ribbon as will be explained in more detail hereinbelow. The plate 54 may include a dowel pin 58 that fits into the drilled hole 60 to prevent the plate from rotating and a bolt 62 that fits through hole 64 formed in plate 56 and is threaded to the complementary threads 66 formed in the bore 68 to support the plates together leaving a small gap for allowing the ribbon to pass therebetween. The leading edge 70 of plate 54 is rounded to minimize the friction between that edge and the ribbon passing thereover and the portion 72 adjacent the bottom edge of the plate 56 is recessed and beveled to define a blade-like element where the ribbon comes into contact therewith as it is drawn thereover. A like configuration is provided on the diametrically opposed side to allow either side of the plate 56 to be used.

Figure 6:
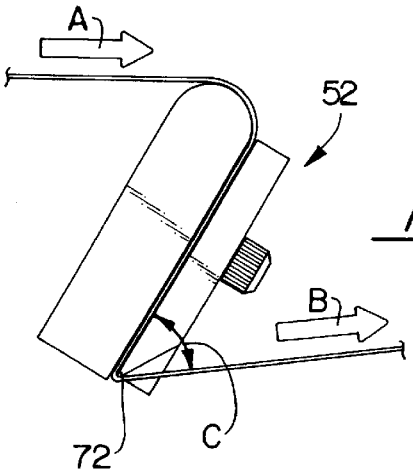
FIG. 6 is a side view and schematic illustration of the curling mechanism of FIG. 5 illustrating the exit angle that the ribbon makes relative to the curling mechanism that can be changed to change the curling characteristic of the ribbon.

As shown in FIG. 6 the ribbon as depicted by the arrow A is threaded over the curved surface of plate 54 and passes between plates 54 and 56 and then over the edge 74 of the recessed portion 72 and led away therefrom as indicated by arrow B. In these embodiments there is virtually no tension in the ribbon upstream of the curling mechanism 52, save for the amount needed to allow the ribbon to progress through the machine and most of the tension on the ribbon occurs between the edge 76 and the drum. By virtue of this arrangement, the curling mechanism 52 can be oriented to change the angle C formed between the plate 56 and the ribbon. The angle C that is selected will determine the curvature of the curl in the ribbon. In other words, a more acute angle will impart a more severe curl and a less acute angle, i.e. an angle closer to 90 degrees will impart a larger diameter curl.

In addition to the curling mechanism, as described above, the automated machine as best seen in FIG. 3 includes the rotating drum 80 with specific stations (similar to those depicted in FIG. 2), namely, the ribbon clamping station 82, the cutting station 84 and the stapling station 86. The ribbons are similar to FIG. 2 mounted on the base 86 and includes a slotted upstanding member 81 that guides each of the ribbons into the curling mechanism 52, the guiding spools 83 and 85 also similar to that shown in FIG. 2. The base 88 supporting the drum 80 for rotary motion is supported in an upright position by a suitable cabinet 90 so that when the end product is completed it will fall by gravity to the bottom. The card feeding mechanism 92 which is sequentially placed in position at the stapling station may be pivotally mounted to swing radially outward away from drum 80 after the stapling so that after being cut in the cutting station 92 it will avoid being snag or tangled with the machinery. It will be apparent that the ribbon may or may not be curled at the initial load-up, i.e. when first loaded onto the clamp, but thereafter, as the drum begins its rotation, the ribbon is curled as it is pulled over the curling mechanism 52.

The actuators for controlling the function at the various stations of the drum during operation of the machine are supported internally of the drum in this embodiment and the actuators for controlling the card feeding and card cutting mechanisms are located away from the central portion of the drum and will be described in detail herelinbelow. A control panel generally illustrated by reference numeral 93 mounted on the machine includes suitable commercially available switches that serve to turn on and off the machine, to override the automatic sequence of the machine's functions which are controlled by a central processing unit 94, that sequences the rotation of the drum, controls the various actuators both internal and external of the drum and the electric motor 96, as will be explained hereinbelow. The main control for the machine is a special digital computer including a programmable logic controller unit (PLC) that serves to control the sequencing operations of the machine. The control panel may contain control buttons for jogging the rotational position of the drum, permitting individual actuation of the actuators so as to allow the initial threading of the ribbons, to initiate the automatic and continuous operation of the machine and may include an emergency stop. The PLC is commercially available, as for example, from the Mitsubishi Company of Japan and is of the type that can be programmed which is typically done by a computer programmer to perform the necessary functions as needed.

FIGS. 4, 7*a*, 7*b*, 8*a*, 8*b*, 9*a*, 9*b*, 10*a* and 10*b*, illustrate schematically the details of the machine excluding the card feed and card cutting mechanisms. As noted therein the drum 80 at the clamping station 100 and cutting station 102 is flattened and this flattened portion 103 has disposed adjacent thereto the jaws 104 and 106 and the cutting blade 109. Actuators 108, 110, 112 and 114 serve to control the position of jaws 104 and 106. Actuator 108 serves to rotate jaw 104, actuator 110 serves to rotate jaw 104, actuator 112 serves to position jaw 104 radially outwardly relative to jaw 106 and actuator 114 serves to position both jaws 104 and 106 radially outwardly together with respect to the drum 80.

Figure 7:
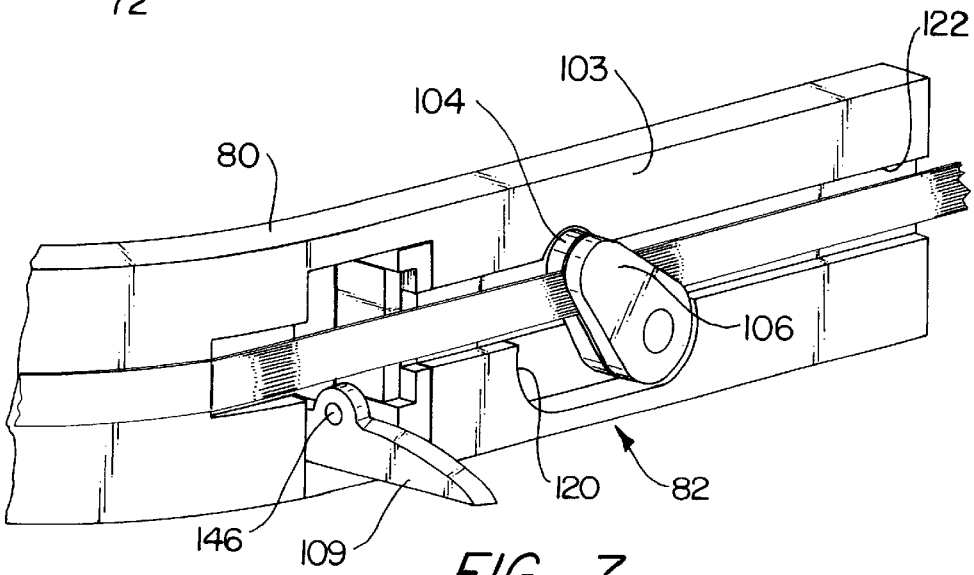
FIG. 7 is a partial view in perspective illustrating the clamping and cutting stations of this invention.
Figure 8A:
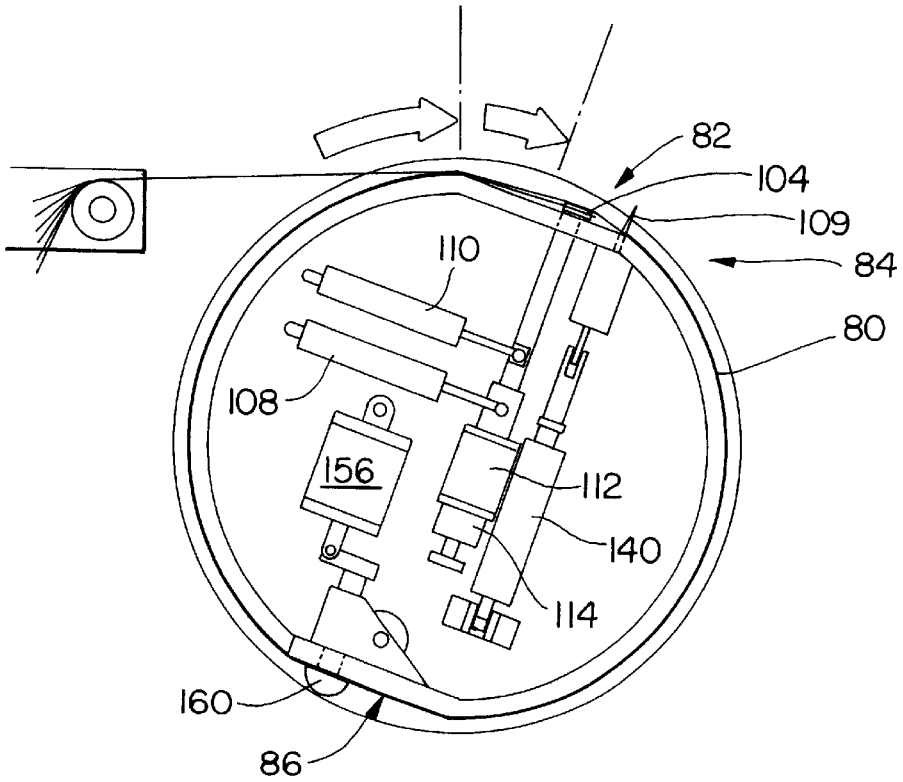
FIG. 8*a* is a schematic illustration of the various stations on the drum and the actuation mechanisms associated with each of the stations for the automated machine of this invention where the drum is at a given location for one of the functions of the cycle.
Figure 8B:
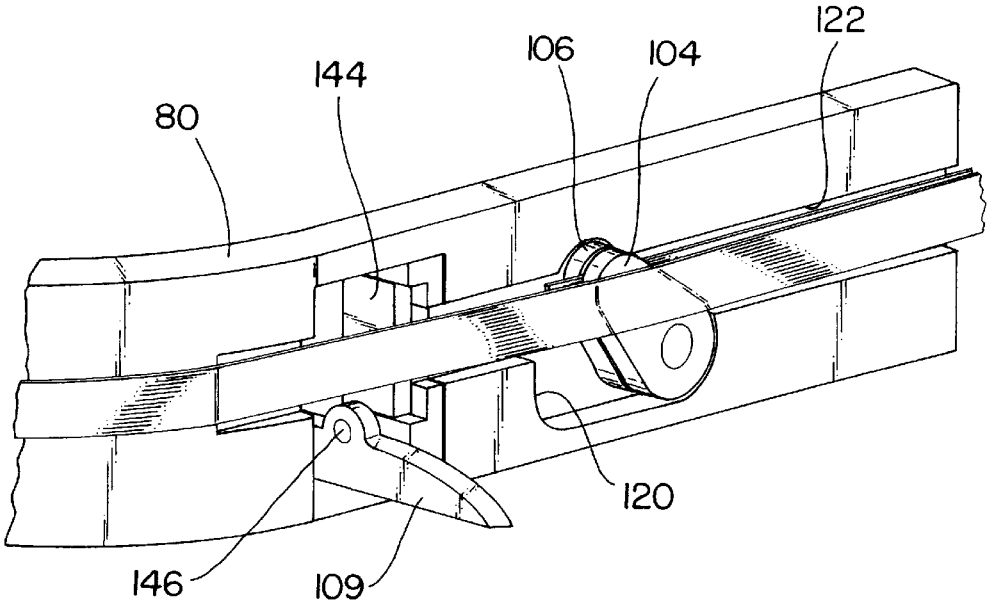
FIG. 8*b* is a elevated view of the a portion of the drum at one of the stations illustrating the position of the clamp and ribbons at the location of FIG. 8*a;*
Figure 9A:
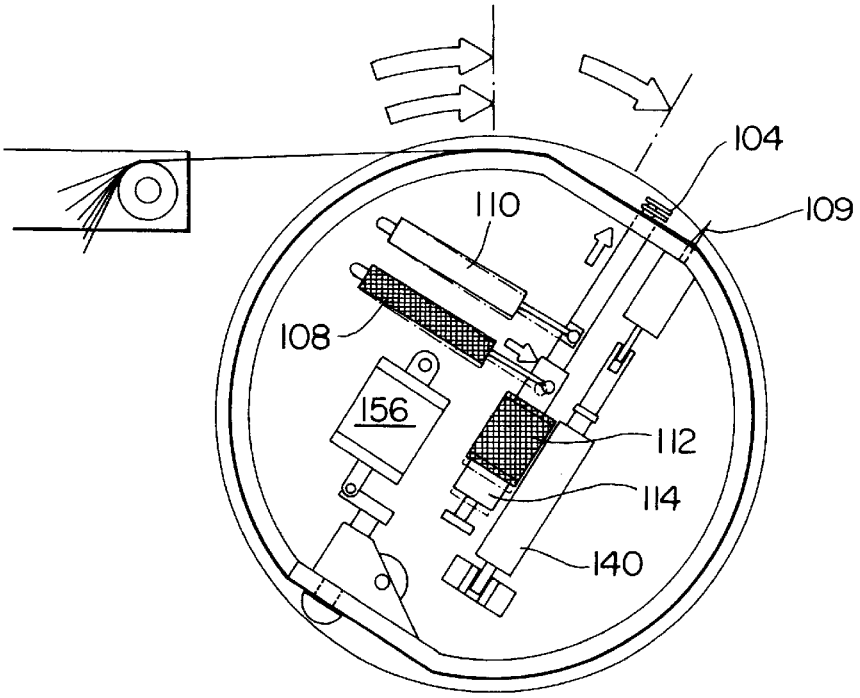
FIG. 9*a* is identical to FIG. 8*a* illustrating a different location of the drum at a different function of the machine during the cycle of operation.
Figure 9B:
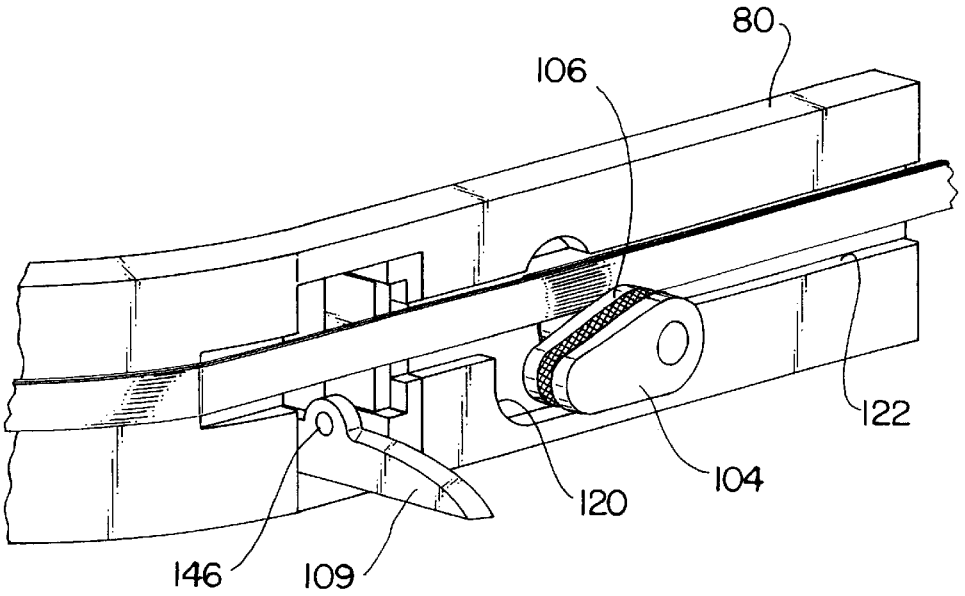
FIG. 9*b* is identical to FIG. 8*b* illustrating the a different position of the clamp and ribbon at the location of FIG. 9*a;*

This portion of the description will describe the operation of the clamping mechanism and referring next to FIG. 7, the flattened portion 103 at clamping station 82 includes a recess portion 120 for receiving the jaws 104 and 106 and the partially annular groove 122 partially extending around the circumference receives and guides the first layer of the six (6) curled ribbons. As noted the jaws are in the clamped position in this FIG. 7. In the initial threading of the machine and before clamping this layer of curled ribbons between the jaws 104 and 106, these jaws are positioned radially outwardly relative to drum 80 and jaw 104 is positioned radially outwardly with respect to jaw 106 providing a gap to accept the curled ribbons (noting that in this embodiment that each layer includes six (6) curled ribbons). Once the clamp is threaded, the jaws are brought together and retracted into the recess portion 120 to clamp the ribbons, and the initial layer of ribbons rides in groove 122 by virtue of actuating the electric servo motor 96 to rotate drum 80. After the drum has rotated one or more revolutions depending on the number of strands that are required to make up the desired end product the clamping mechanism will be activated to release the layers of ribbons constituting the end product and re-activated to capture the layer of ribbons for the next cycle of operation so as to mass produce the end product. For example and for explanation purposes, assume that the end product will contain twenty-four (24) strands of curled ribbons emanating from the staple, noting that the cutting of the ribbon is 180° away from the stapling station, the drum will make two revolutions (each revolution of the layer of six (6) ribbons makes 12 strands relative to the staple). After the first revolution and when the second bundle of six curled ribbons overlay a portion of the first bundle of six curled ribbons, the combined underlayer and over layer will hold the ribbons to the drum without the assistance of the clamping mechanism. This portion of the machine's operation is shown in FIGS. 8*a* and 8*b* where it can be seen that the underlayer is clamped between the jaws and the over layer lies over the jaws.

At this juncture point of the machine operation the jaws are actuated to perform a sequence of moves so as to clamp the next layer of six (6) ribbons to be ready for the next cycle. One cycle produces one end product. While the drum is rotating the cylinders 112, 108 and 110 are actuated to open the jaws and rotate the jaws downwardly below the ribbon path. This permits the jaws to release the underlayer of ribbons and to be moved away from the path of the ribbons drawn over the drum 80. Cylinder 114 is then actuated to position the jaws 104 and 106 away from the drum. This is demonstrated in FIGS. 9*a* and 9*b*.

Figure 10A:
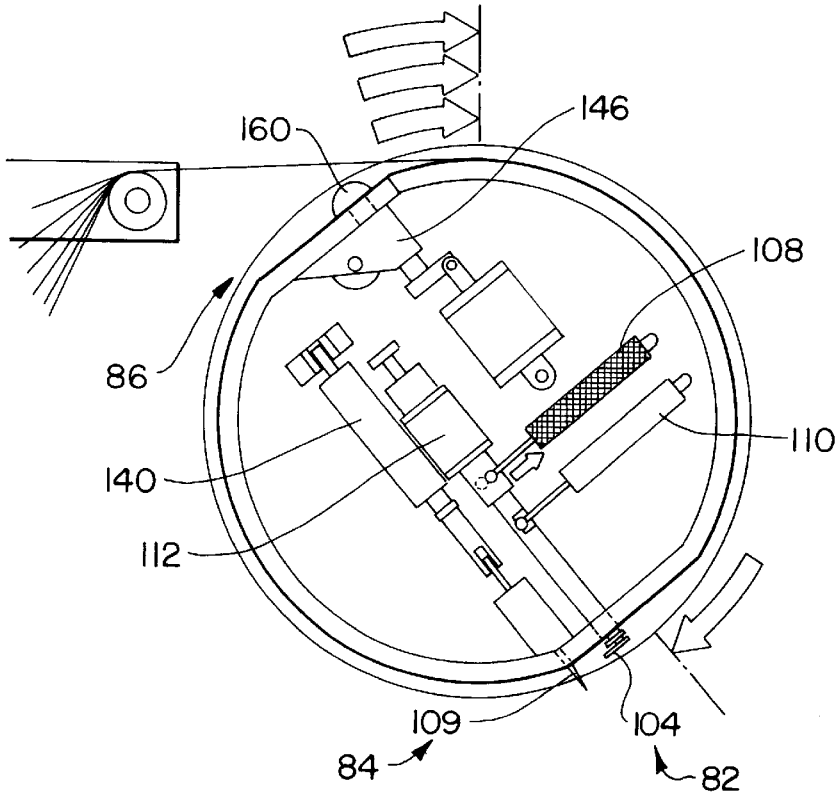
FIG. 10*a* is identical to FIG. 9*a* illustrating a different location of the drum at a different function of the machine during the cycle of operation.
Figure 10B:
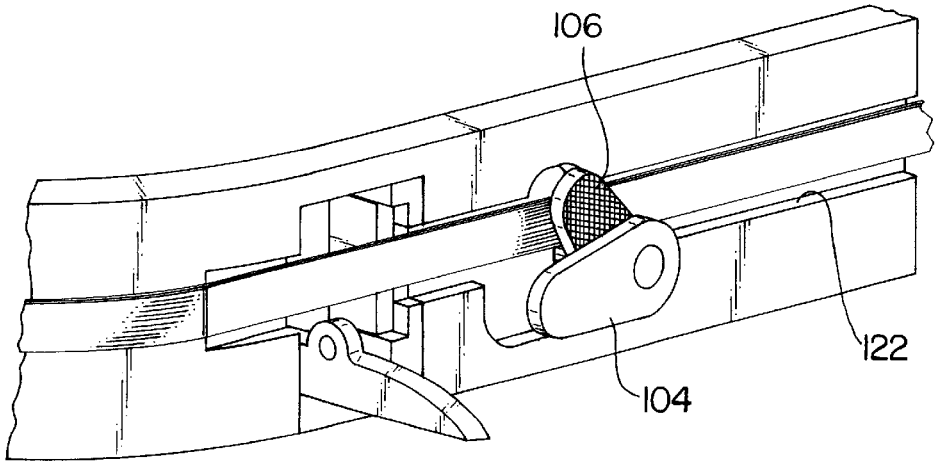
FIG. 10*b* is identical to FIG. 9*b* illustrating the a different position of the clamp and ribbon at the location of FIG. 10*a;*
Figure 11A:
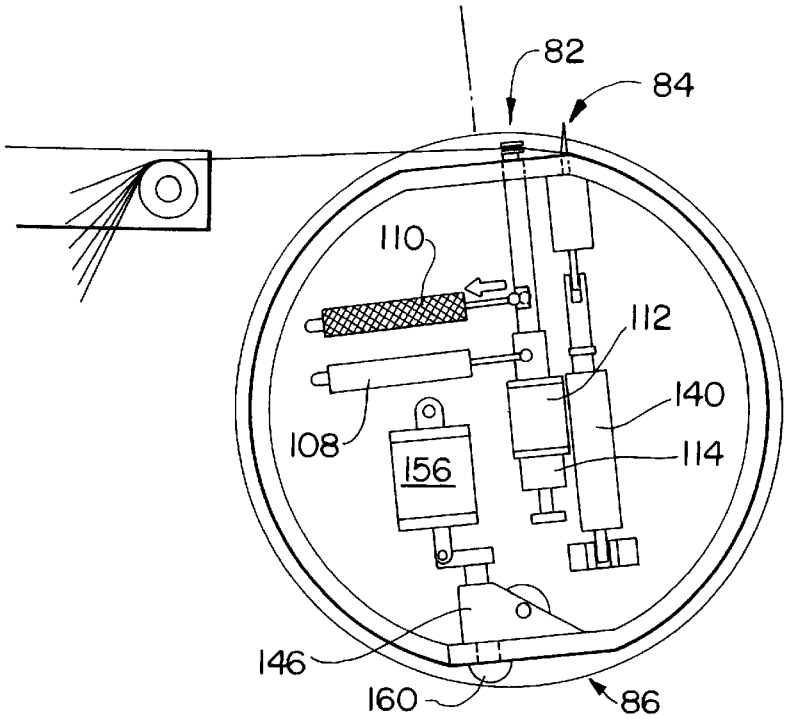
FIG. 11*a* is identical to FIG. 10*a* illustrating a different location of the drum at a different function of the machine during the cycle of operation.
Figure 11B:
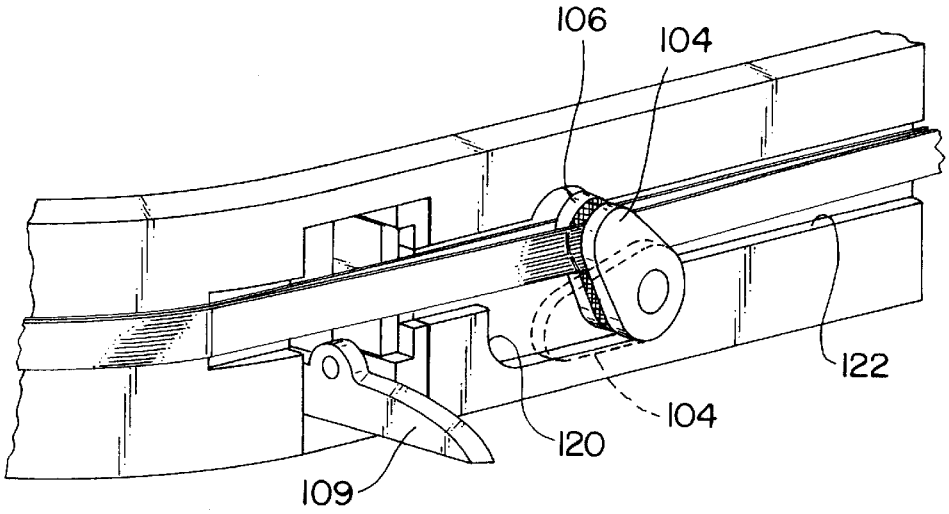
FIG. 11*b* is identical to FIG. 10*b* illustrating the a different position of the clamp and ribbon at the location of FIG. 10*a;*

Before the completed revolution of the second layer of ribbons and during the first cycle, the lower jaw 104 is rotated back in the path of the ribbon by cylinder 110 as seen in FIGS. 10*a* and 10*b*. After the portion of the second layer of ribbons passes over the lower jaw 104 the cylinder 108 is actuated to bring the upper jaw 106 in line with the lower jaw 104 and the cylinder 112 is activated to bring both jaws together and clamp the ribbon as seen in FIGS. 11*a* and 11*b*. The jaws 104 and 106 are held radially outwardly away from drum 80 until after the cutting and stapling occurs and the next cycle commences.

This portion of the description describes the cutting and stapling operation of the automatic curled ribbon making machine. After the clamp secures the bundle of ribbons to begin the next cycle, the motor is activated to the stop position. While it isn't necessary to stop the rotation of the drum since it is possible to perform the next operations while the drum is moving, in its preferred embodiment the stapling and cutting is done while the machine is at rest. To perform the cutting operation, cylinder 140 is actuated to rotate the blade 142 extending through an aperture 144 formed in drum 80. Blade 142 is pivotally connected to drum 80 by the pin 146 and the reciprocating action of the connecting arm pivots the blade 142 to cause it to cut through the ribbon.

Figure 12B:
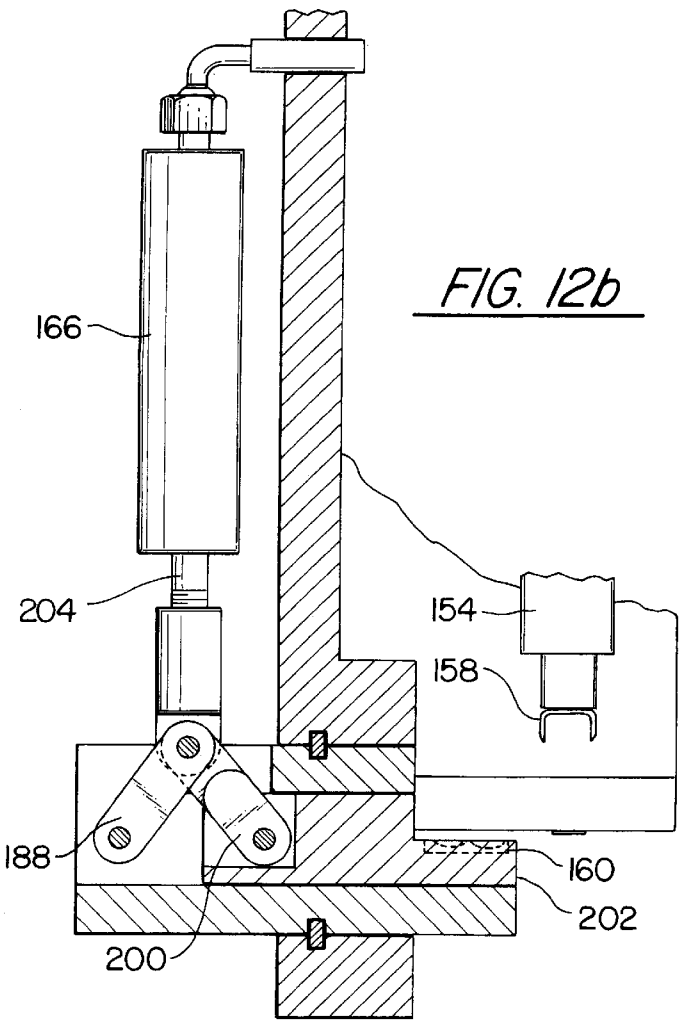
FIG. 12*b* is identical view of FIG. 12*a* illustrating the staple and anvil in the non-deployed position.
Figure 12A:
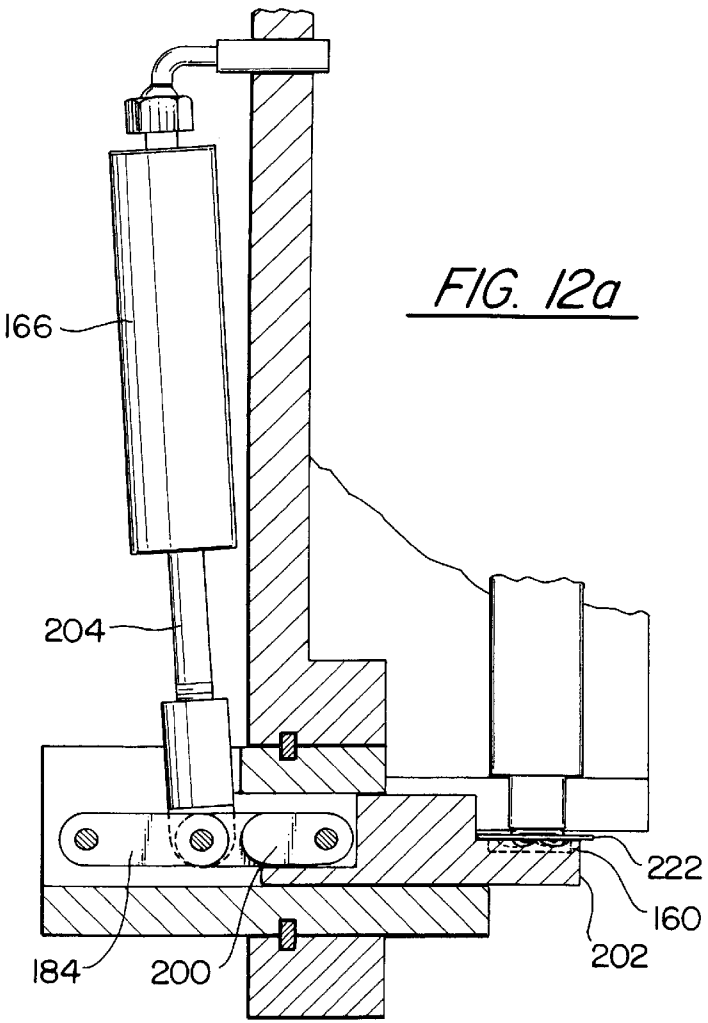
FIG. 12*a* is a partial view partly in section, partly in elevation and partly in schematic illustrating the anvil and stapling mechanism of this invention in the deployed position.

Obviously, it is necessary to staple or join the respective layers of six ribbons prior to the cutting operation and this portion of the description describes the stapling operation of the machine. The stapling is accomplished in the preferred embodiment by a commercially available industrial type of cartridge feed stapler 146 which may be a Swingline stapler obtained from Swingline Inc. of Long Island City, N.Y. As best seen in FIGS. 12*a* and 12*b* the stapling is done at the stapling station 86 which similar to the cutting and clamping stations is a flattened portion 152 of the periphery of drum 80. Stapler 146 includes a hammer 154 actuated by cylinder 156 that urges the continuous feed staple 158 toward the anvil 160 that causes one of the staples to pass through the ribbon and card 162 to secure all the individual ribbons and card together to form the end product. The raising and lowering of the anvil 160 is controlled by the cylinder 166 that pushes the pivoted links 188 and 200 via push rod 204 to cause the Y-shape to an I-shape to drive the anvil block 202 up and down.

Figure 13:
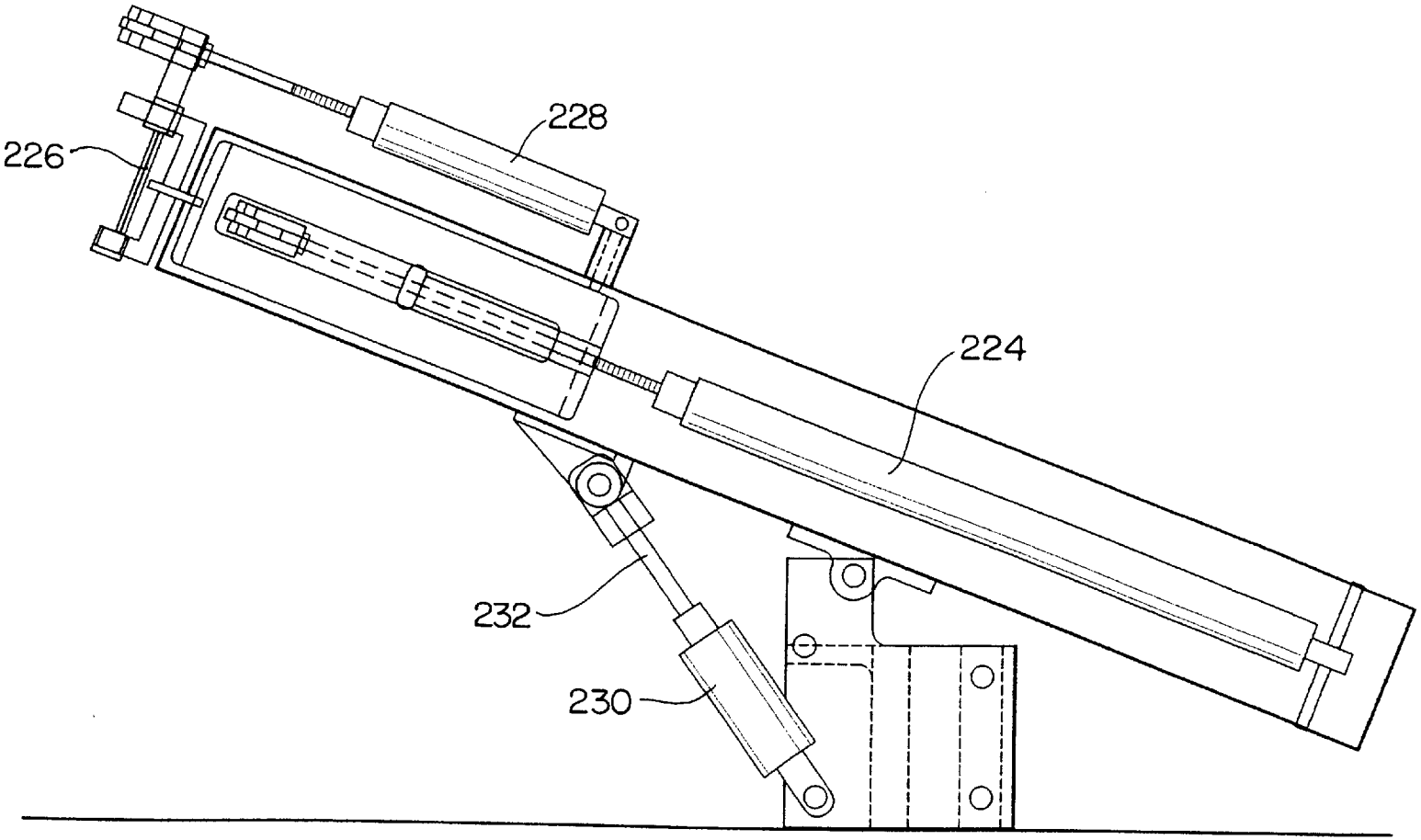
FIG. 13 is a plan view of the card feeding mechanism of this invention.

The automatic card feeder 220 as best shown in FIG. 13 serves to automatically feed the cards 222 between the anvil 160 and staple 154 (FIGS. 12*a* and 12*b*). The cartridge of cards is feed to the feeder 220 and the cards are urged toward the anvil 160 via the actuator 224 until properly located. The commercially available rotary cutter 226 and cylinder 228 serve cut the card after being stapled to the ribbons. The automatic card feeder 220 is mounted to the base 88 (FIG. 3) adjacent to the drum 80 by the actuator 230 and push rod 232 which supports the automatic card feeder 220 for pivotal movement away from drum 80 once the card is attached to the ribbon and held by the automatic card feeder 220. Once the end product is spaced away from the drum 80 the card is cut and released from the card feeder 220 and allowed to drop into a suitable carton or conveyor belt as the case may be. If necessary, a blow off nozzle or as many as need be may be employed to assure that the strands of ribbons, which are essentially free floating from the card, does not become ensnared with the mechanism.

To understand the medium for controlling the various function of the automated curled ribbon curling machine and the interconnection between the various components reference will now be made to block diagram configuration of FIG. 14. In this diagram all of the solid lines represent electrical connection, all of the dash lines represent pressurized air feed hoses connections and all of the dot/dash lines represent feedback connections to the PLC. The PLC produces sequential signals to the individual commercially available solenoid valves generally indicated by reverence numeral 240. Each cylinder is connected to the air manifold which is connected to a supply of pressurized air by virtue of opening and closing the respective solenoid valves to actuate and de-actuate the respective cylinder. Cylinder 108 actuating jaw 104, cylinder 110 actuating jaw 106, cylinder 140 actuating the cutter 142 and cylinder 166 actuating the anvil 160 are commercially available compressed air actuated actuators and suitable actuators of this type, for example are Clippard Cylinders available from the Clippard Instrument Laboratory, Inc. Of Cincinnati, Ohio. The cylinder 156 actuating the stapler and the cylinder 112 actuating the jaws to cause them to separate are also commercially available compressed air actuator and a suitable actuator is a Festo pneumatic actuator available from the Festo Inc. Of Hauppauge, N.Y. The cylinder 114 actuating both jaws together is also a compressed air actuator and a suitable actuator is a Fabco-Air available from Fabco-Air of Gainesville, Fla. The card feed actuator cylinder 224 and the rotary cutter cylinder 228 are also commercially available and a suitable actuator is a Bimba, available from Bimba Manufacturing Company, Monee, Ill.

It is apparent from the foregoing that the PLC will generate sequential signals to cause the various solenoid valves 250, 252, 254, 256, 258, 260, 262 and 264 to interconnect or disconnect the compressed air from a suitable source 290 to feed each of the cylinders through the respective hoses 270, 272, 274, 276, 278, 280, 282 and 284 to perform the functions as was described in the above paragraphs. The blowoff nozzle 292 is shown and as noted above is utilized to assure that the end product doesn't become ensnared with the operating mechanism of the curled ribbon machine and is only used as needed. Feed back sensors for the cutter 142, stapler 146 and anvil 160 serve to feed back the position of each cylinder to the PLC via the lines 294, 296 and 298.

Figure 14:
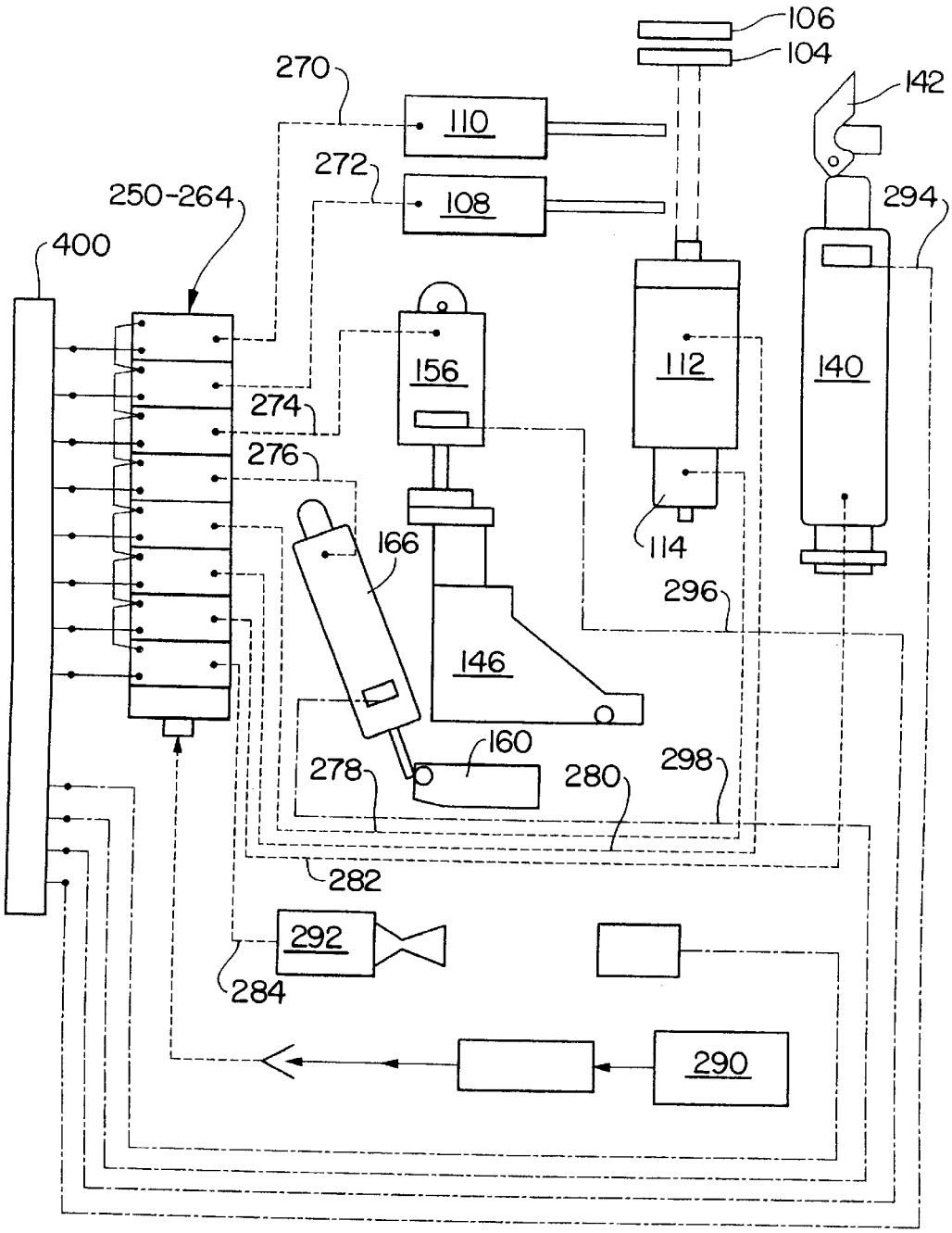
FIG. 14 is a block diagram showing the various actuators within the drum and the medium for actuating these actuators.
Figure 15:
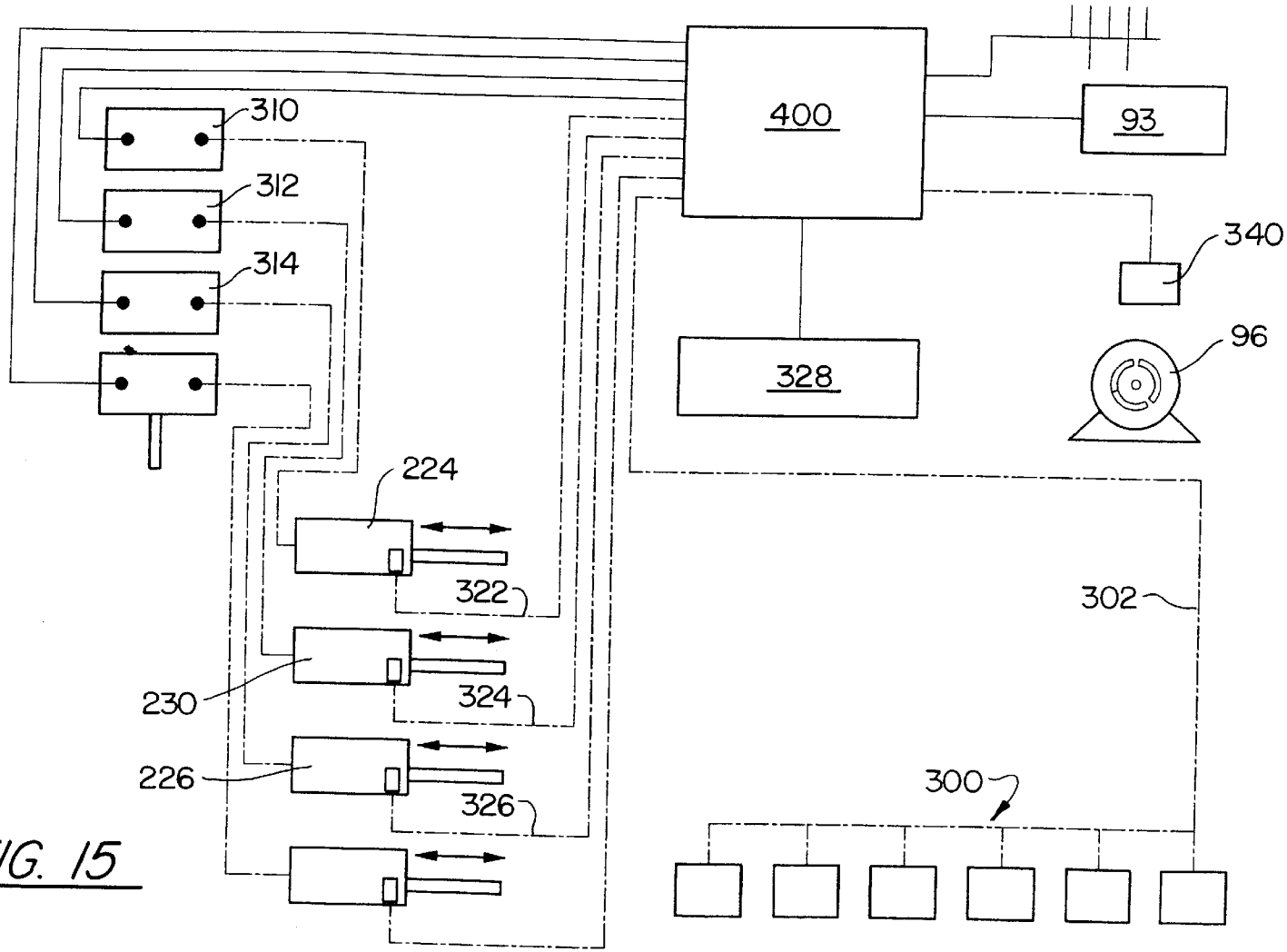
FIG. 15 is a block diagram showing the various actuators outside of the drum and the medium for actuating these actuators.

FIG. 15 is a block diagram similar to FIG. 14 but showing the functions that are not on the drum namely, the card feed cylinder 224, the swing arm cylinder 230, and the card cutter cylinder 226. The solenoid valves 310, 312 and 314 are controlled by the PLC and serve to connect the compressed air to the cylinders 224, 230 and 226 via the air hoses 316, 318 and 320, respectively, for providing the respective functions. Feedback for the positions of these respective cylinders are fed back to the PLC through lines 322, 324 and 326, respectively. The PLC likewise controls the on/off and position of the motor via the motor driver 338 and encoder 340. Each of the ribbons are provided with a break sensor 300 that is connected to the PLC via the feed back line 302.

What has been shown by this invention is different embodiments of a machine for making curled ribbon products, say a multicolored multiple ribbons formed into a plurality of strands of curled ribbon, either individually or by mass production. The individual making is by a portable hand operated machine that includes a drum or reel for winding the ribbon and drawing it through a curling mechanism, where the drum includes stations for attaching the ribbons to the drum, stapling the ribbons and a card or other item together, and cutting the ribbons to form the desired end product. In the mass production machine, the stations are formed on the periphery of the drum and the attaching is by a judiciously sequenced clamping mechanism and a automatic stapling mechanism that accepts cards from an automatic card feeding mechanism so as to staple the ribbons and card together and discretely positioned the end product away from the drum when releasing the end product from the machine.

Although this invention has been shown and described with respect to detailed embodiments thereof it will be appreciated and understood by those skilled in the art that various changes in form and detail thereof may be made without departing from the spirit and scope of the claimed invention.

It is claimed:

1. A hand operated curl ribbon product making machine including a rotatable member having a peripheral surface for winding at least two different ribbons so that a portion of each of said different ribbons overlies another portion of each of said at least two different ribbons and being rotatable by an operator, at least two sources of uncurled different ribbons, a curling mechanism having a contact surface receiving said uncurled different ribbons from said sources where said at least two different uncurled ribbons are curled thereby before being attached to said rotatable member, said rotatable member including a first station, a second station and a third station, said first station providing access to the operator for attaching said at least two different curled ribbons to said rotatable member, a second station providing access for the operator to attach said at least two curled different ribbons and the overlying portions together, and said third station providing access for the operator to cut the curled ribbons to form strands of curled ribbons, whereby a curled ribbon product is made.

2. A hand operated curl ribbon product making machine as claimed in claim 1 wherein said rotatable member is a drum and including a clamp attaching the ends of said at least two different uncurled ribbons, and said first station including an aperture formed in said drum for accepting said clamp.

3. A hand operated curl ribbon product making machine as claimed in claim 2 wherein said clamp is an alligator clamp.

4. A hand operated curl ribbon product making machine as claimed in claim 1 wherein said rotatable member is a drum having a periphery for winding the at least two different ribbons there around and including a handle attached to said drum whereby the operator has access to rotate said drum.

5. A hand operated curl ribbon product making machine as claimed in claim 4 wherein said third station is a slot extending radially inwardly from the periphery of said drum and said slot being located relative to said second station wherein the attaching juncture of said curled ribbons is predetermined.

6. A hand operated curl ribbon product making machine as claimed in claim 2 wherein said second station is a slot extending radially inwardly from the periphery of said drum whereby the operator has access to said curled ribbons to staple said curled ribbons and portions thereof together.

7. A hand operated curl ribbon product making machine as claimed in claim 6 including a card, wherein said slot extending radially inwardly from the periphery of said drum includes a wedged portion for holding said card, wherein said card and said at least two different curled ribbons and portions thereof are stapled together.

8. An automated curled ribbon product machine for the mass production of layers of curled ribbons having at least two sources of ribbons comprising a rotatable member having a peripheral edge for winding the ribbon thereon so that a portion of each of the at least two ribbons overlaps a portion of each of the at least two ribbons, said rotatable member having a first station for attaching the ribbon to the rotatable member, a curling mechanism mounted upstream of said drum wherein the ribbon is in contact with the curling mechanism before being wound on said peripheral edge, a second station for attaching the layers of the wound curled ribbons together and a third station for cutting the layers of the attached curled ribbons to form strands of curled ribbons and defining the end product of curled ribbons.

9. An automated curled ribbon product machine for the mass production of layers of curled ribbons as claimed in claim 8 wherein the rotatable member is a drum, said first station includes a clamp that clamps the ribbons to the drum, then releases the ribbons after at least the upper layer of ribbons on the drum secures the ribbons to the drum, and then re-clamps a portion of said ribbon to begin the next cycle for making the end product of curled ribbons.

10. An automated curled ribbon product machine for the mass production of layers of curled ribbons as claimed in claim 9 wherein said clamp includes a first jaw and a second jaw, a first actuator for said first jaw and a second actuator for said second jaw to rotate said first jaw relative to said second jaw, a third actuator for said second jaw to position said second jaw axially from said first jaw and a fourth actuator for said first jaw and said second jaw to move said first jaw and said second jaw together into and out of a recess formed in the periphery of said drum.

11. An automated curled ribbon product machine for the mass production of layers of curled ribbons as claimed in claim 10 wherein said first actuator, said second actuator, said third actuator and said fourth actuator includes an air cylinder, a source of compressed air, fluid connection from said source to said first actuator, said second actuator, said third actuator and said fourth actuator and a control for controlling the fluid connections to control the interconnection from said source to each of said actuators.

12. An automated curled ribbon product machine for the mass production of layers of curled ribbons as claimed in claim 9 including a stapler for stapling the layers of ribbons together.

13. An automated curled ribbon product machine for the mass production of layers of curled ribbons as claimed in claim 12 including an actuator for actuating said stapler, a source of compressed air, a fluid connection interconnecting said source and said actuator, and a control for controlling the fluid connection to sequentially staple said ribbons together at a predetermined time in the cycle of producing a curled ribbon end product.

14. An automated curled ribbon product machine for the mass production of layers of curled ribbons as claimed in claim 13 including a reciprocal anvil, an anvil actuator, and another fluid connection interconnecting said source and said anvil actuator for reciprocating said anvil so that said anvil is in line with said stapler when said stapler is attaching said ribbons together.

15. An automated curled ribbon product machine for the mass production of layers of curled ribbons as claimed in claim 14 including a card feeding mechanism for locating a card in proximity to the juncture where said ribbons are being stapled together, and said stapler stapling said card together with said ribbons and a cutter for cutting the card to a predetermined size.

16. An automated curled ribbon product machine for the mass production of layers of curled ribbons as claimed in claim 15 including a card positioning actuator for positioning said card, a fluid connection interconnecting said source and said actuator and said control controlling said fluid connection for actuating said card positioning actuator.

17. An automated curled ribbon product machine for the mass production of layers of curled ribbons as claimed in claim 16 including a cutter actuator, a fluid connection interconnecting said source and said cutter actuator and said control means controlling said fluid connection to cut said card at a predetermined time.

18. An automated curled ribbon product machine for the mass production of layers of curled ribbons as claimed in claim 17 including a ribbon cutter, a ribbon cutter actuator, and a fluid connection interconnecting said ribbon cutter actuator and said source for cutting said ribbon at a predetermined time.

19. An automated curled ribbon product machine for the mass production of multi layers of curled ribbons from uncurled ribbons comprising a rotatable member, a first station for attaching the uncurled ribbons, said rotatable member having a second station for attaching the curled ribbons together and a third station for cutting the attached curled ribbons, a plurality of spools of uncurled ribbons, said first station including a clamp for accepting the number of uncurled ribbons intended for the end product for winding around said rotatable member, a curling mechanism including a contact surface, said clamp attaching said uncurled ribbon to place each of the ribbons of said intended end product on said contact surface so that the curl is imparted to each of said uncurled ribbons of the intended end product while the rotatable member rotates, an attaching mechanism at said second station attaching each of said ribbons intended as the end product and a cutter mechanism at said third station for cutting said attached ribbons.

20. An automated curled ribbon product machine for the mass production of multi layers of curled ribbons as claimed in claim 19 including a card feeding machine for placing a card in close proximity to said multi layers of curled ribbons for being attached to said ribbons at the attaching station.

21. An automated curled ribbon product machine for the mass production of layers of curled ribbons having at least two sources of ribbons comprising a rotatable drum having a peripheral edge for winding the ribbon thereon so that a portion of each of the at least two ribbons overlaps a portion of each of the at least two ribbons, said drum having a first station for attaching the ribbon to the drum, a curling mechanism mounted upstream of said drum wherein the ribbon is in contact with the curling mechanism before being wound on said peripheral edge, a second station for attaching the layers of the wound curled ribbons together and a third station for cutting the layers of the attached curled ribbons to form strands of curled ribbons and defining the end product of curled ribbons, said first station includes a clamp that clamps the ribbons to the drum, then releases the ribbons after at least the upper layer of ribbons on the drum secures the ribbons to the drum, and then re-clamps a portion of said ribbon to begin the next cycle for making the end product of curled ribbons, said clamp includes a first jaw and a second jaw, a first actuator for said first jaw and a second actuator for said second jaw to rotate said first jaw relative to said second jaw, a third actuator for said second jaw to position said second jaw axially from said first jaw and a fourth actuator for said first jaw and said second jaw to move said first jaw and said second jaw together into and out of a recess formed in the periphery of said drum, said first actuator, said second actuator, said third actuator and said fourth actuator includes an air cylinder, a source of compressed air, fluid connection from said source to said first actuator, said second actuator, said third actuator and said fourth actuator and a control for controlling the fluid connections to control the interconnection from said source to each of said actuators, a stapler for stapling the layers of ribbons together, a stapler actuator for actuating said stapler, a fluid connection interconnecting said source and said stapler actuator, a control for controlling the fluid connection to sequentially staple said ribbons together at a predetermined time in the cycle of producing a curled ribbon end product, an anvil actuator, another fluid connection interconnecting said source and said anvil actuator for reciprocating said anvil so that said anvil is in line with said stapler when said stapler is attaching said ribbons together, a ribbon cutter, a ribbon cutter actuator, a fluid connection interconnecting said ribbon cutter actuator and said source for cutting said ribbon at a predetermined time.

22. An automated curled ribbon product machine for the mass production of layers of curled ribbons as claimed in claim 21, including a card positioning actuator for positioning said card, a fluid connection interconnecting said source and said actuator and said control controlling said fluid connection for actuating said card positioning actuator, and a cutter actuator, a fluid connection interconnecting said source and said cutter actuator and said control means controlling said fluid connection to cut said card at a predetermined time.

23. Apparatus for making strands of curly ribbon from uncurled ribbon comprising a rotatable member having a peripheral edge adapted for winding the curled ribbon thereon so that a portion of the curled ribbon overlaps a another portion of said curled ribbon for defining a layer of curled ribbon, said rotatable member having a station for attaching the curled ribbon to said rotatable member, a curling mechanism mounted upstream of said rotatable member adapted to receive uncurled ribbon to engage said uncurled ribbon with the curling mechanism before being wound on said peripheral edge, said rotatable member having other stations for attaching the layer of the curled ribbon together and for cutting the layer of the curled ribbon to form strands of curled ribbon and defining the end product of strands of curly ribbon.

24. Apparatus for making strands of curled ribbon as claimed in claim 23 including a stapling mechanism, said stapling mechanism operable in one of said stations for stapling said layer of said curled ribbon together.

25. Apparatus for making strands of curled ribbons as claimed in claim 24 including a card, said card being inserted into said station and being stapled by said stapling mechanism so that said card and said layer of curled ribbon are stapled together.

* * * * *